United States Patent [19]

Saverino

[11] 4,432,552

[45] Feb. 21, 1984

[54] GOLF PRACTICE APPARATUS

[76] Inventor: Bennett J. Saverino, 73-36 196th St., Flushing, N.Y. 11365

[21] Appl. No.: 368,525

[22] Filed: Apr. 15, 1982

[51] Int. Cl.[3] ..... A63B 69/36

[52] U.S. Cl. ..... 273/183 A; 273/193 R; 273/195 A

[58] Field of Search ..... 273/32 R, 171, 81 A, 273/195 B, 195 A, 195 R, 193 R, 193 A, 194 R, 183 A, 202, 80 B

[56] References Cited

U.S. PATENT DOCUMENTS

| | | | |
|---|---|---|---|
| 1,167,387 | 1/1916 | Daniel | 273/81 A X |
| 3,302,344 | 2/1967 | Wolfe et al. | 273/32 R X |
| 3,639,923 | 2/1972 | Stewart | 273/195 B X |
| 3,975,024 | 8/1976 | Stephan | 273/195 A X |
| 3,999,765 | 12/1976 | Bishop | 273/171 X |

*Primary Examiner*—George J. Marlo
*Attorney, Agent, or Firm*—Allison C. Collard; Thomas M. Galgano

[57] ABSTRACT

A golf practice apparatus consisting of an elevated table or platform having an artificial grass surface with a tee mounted therein and supported on a plurality of legs, each of which are adjustable in height. A golf club of reduced length is used in combination with the table, so that full swing practices can be made within the confines a normal room. The table also includes a sighting ball as a reminder to the player to keep his head in back of the ball throughout the swing, and the clubs are appropriately weighted at each end, to compensate for the amount of shaft removed from the clubs when they are shortened.

4 Claims, 10 Drawing Figures

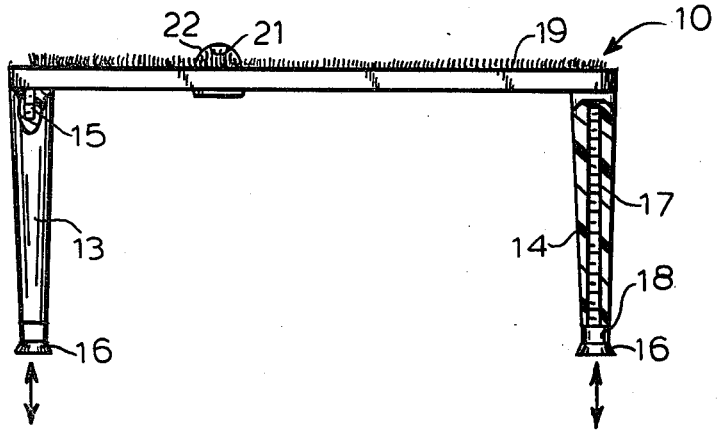
FIG.1
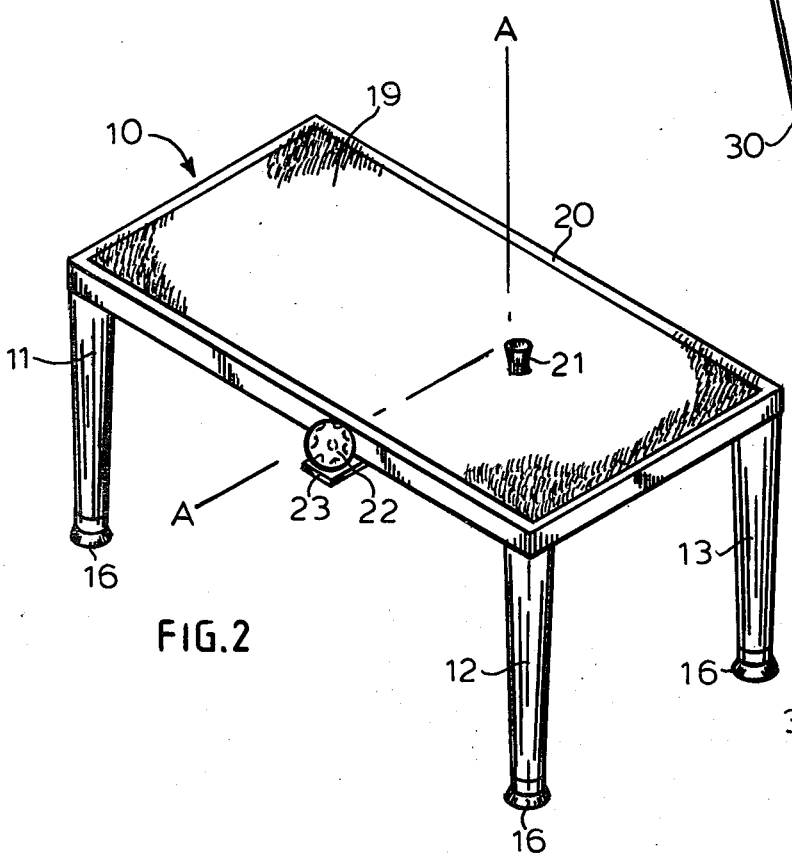
FIG.2
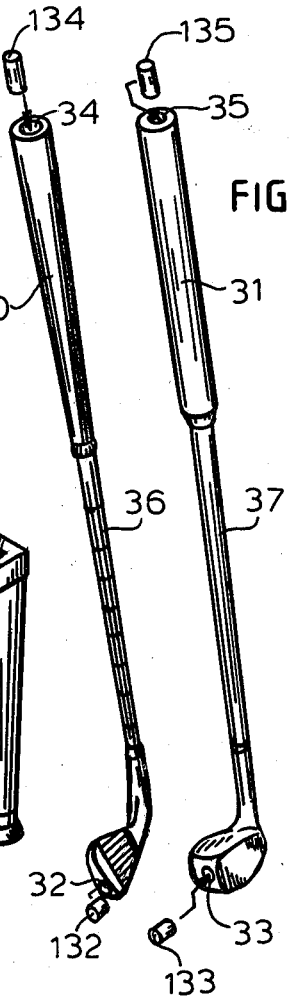
FIG.7
FIG.8

GOLF PRACTICE APPARATUS

This invention relates to an improved golf practice apparatus using a stand and shortened golf clubs, to simulate actual golf playing conditions.

More specifically, this invention relates to a golf practice game, with a stand and shortened golf clubs, which can be used to practice the game of golf in a confined area, such as in the room of a building.

In practicing for a golf game, it is often necessary to take golf clubs out of doors, so that a full practice swing can be accomplished, without interfering with the walls or ceiling of a room. In many instances, either because of weather conditions or accommodations, it is not possible to practice golf using a full swing. There are many different golf practice devices available, primarily used for putting but are not suitable for golf driving or practising fairway swings.

Accordingly, the present invention provides an improved practice apparatus, having a raised table and carefully weighted and balanced shortened golf clubs, so that full practice swings can be accomplished in a confined area for driving either real or plastic golf balls. In the elevated table or platform of the invention, the legs are adjustable so that the user can simulate a sloping terrain or hill, while the ball is being driven. In the approximate center of the elevated table is a golf tee, for receiving the golf ball. The club that is used has been shortened to approximately two-thirds. of its original length, and has been carefully weighted and balanced, so that the net effect is to provide the user with the feel of a large club with a full swing within an approximately 7-foot radius.

It is therefore an object according to the present invention, to provide a golf practice apparatus, consisting of an adjustable, elevated table and a shortened golf club, to simulate a full golf swing.

It is another object according to the present invention, to provide a golf practice apparatus, which is simple in design, inexpensive to manufacture and reliable in operation.

Other objects and features of the present invention will be become apparent from the following detailed description considered in connection with the accompanying drawings which show the embodiments of the invention. It is to be understood that the drawings are designed for the purpose of illustration only, and not as a definition of the limitations of the claims.

In the drawings wherein similar reference characters denote similar elements throughout the several views:

FIG. 1 is a side view, partially in cross section, of the golf practice table, according to the invention;

FIG. 2 is a perspective view, slightly in elevation, of the golf practice table of FIG. 1;

FIG. 7 is a perspective view of a golf iron, used in connection with the golf table of FIG. 1, according to the invention;

FIG. 8 is a perspective view of a golf driver, used in connection with the practice table, according to the invention;

Figure 3:
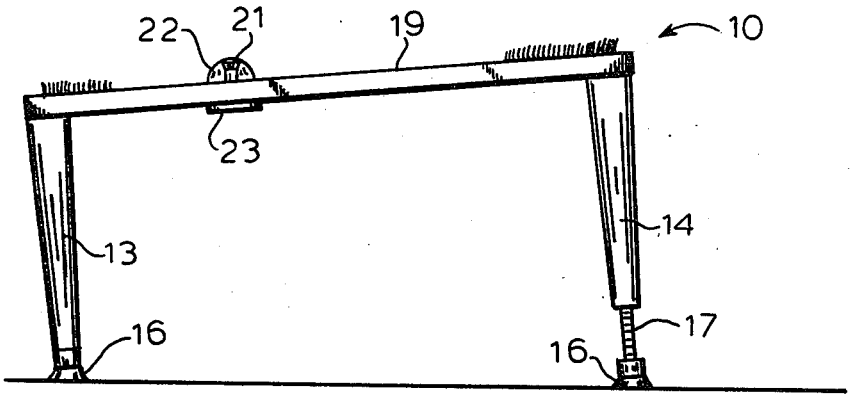
FIGS. 3, 4, 5 and 6 illustrate the golf practice table in various sloping arrangements.
Figure 4:
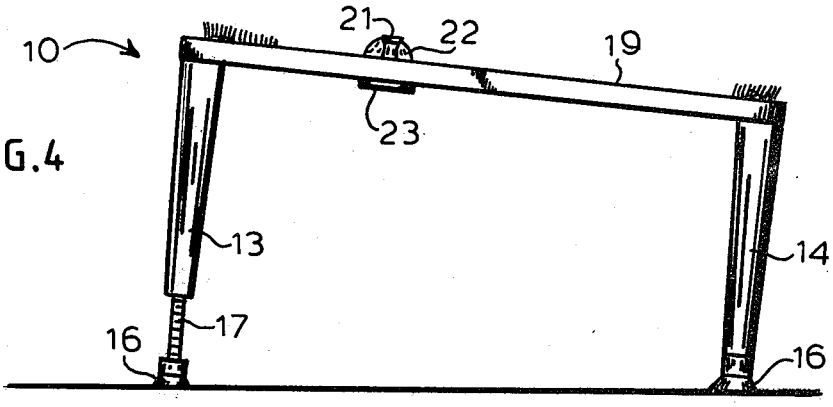

Referring to FIGS. 1 and 2, there is a shown the golf practice table 10, according to the invention, having four verticle legs 11, 12, 13 and 14, secured to each of the corners of the table. These legs may be detachably screwed on to the corners of the table by means of a thread 15, as shown in detail in FIG. 1 with respect to leg 13, as is well known in the prior art. Each of the legs 11–14 is provided with a foot 16, preferably constructed of resilient material, such as rubber or neoprene on a metal collar 18, which is connected to threadable shaft 17. Shaft 17 is threadably disposed within a hollow portion of legs 1–14, so that the foot and collar can be extended from the end of the leg in order to adjust the tilt of the table. In place of shaft 17, each leg could also be provided with a telescoping portion and locking screw as in commonly used in photographic tripods. Each foot can be adjusted and set to any desired height, as shown in detail in FIGS. 3–6.

Table 10 is also provided with an artificial grass surface 19, which is secured on the top surface of the table, preferably within a four-sided frame 20, defining the top of the table. A resilient or rubber golf tee 21 is provided in the center field of the grass and mounted preferably on the lower surface of the table, in order to support a golf ball at the proper driving height. Directly to one side of the golf tee is also provided a sighting or positioning ball 22, secured to the side of the table by means of step 23. Ball 22 is preferably mounted on a plane passing through tee 21, parallel to the front or back edge of the table. Sighting ball 22 is a reminder to the player to position his head behind the ball throughout the entire swing of the club.

Figure 5:
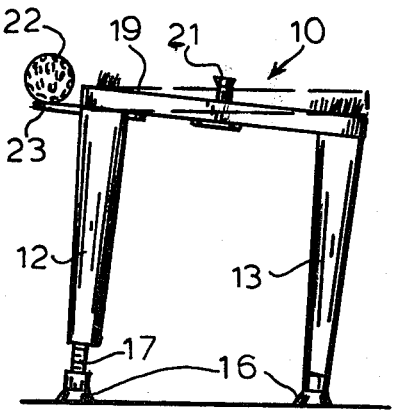
Figure 6:
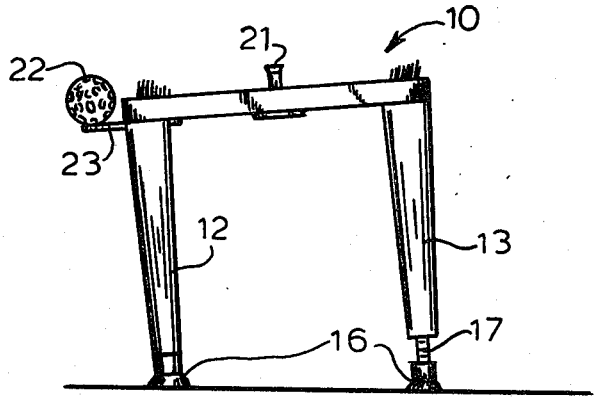

To simulate a downhill lie of the ball, the apparatus of the invention can be adjusted as shown in FIG. 3, with the back legs 14 and 11 being elevated, as shown. Likewise, to simulate a uphill lie, front legs 12 and 13 can be elevated by means of unscrewing foot 16 at the bottom of the legs to a lower setting. In a similar manner, a side slope to the left or the right can be simulated by adjustment of suitable legs, as shown in FIGS. 5 and 6.

Referring FIGS. 7 and 8, there is shown the shortened iron and driver clubs 30 and 31. Suitable weights 132 and 133 can be added through openings 32 and 33 at the end of the clubs, for balance. Likewise, weights 134 and 135 can be added through openings 34 and 35 at the handle ends of the clubs to also balance the clubs. Weights can also be added to the stem or hosel of the club, the back of the club and on the bottom of the wood head of the driver. As an alternative, the weight of the shaft and the head can be increased to balance the club by making them heavier.

In an actual embodiment of the invention, the table was constructed 18" in length by approximately 9" in width, with the tee set back 6 to 6½" from one end. The legs are approximately 9" in length, so that the top of the table is approximately 10" off the floor before the legs are extended, as in FIGS. 3–6.

In an actual embodiment of the clubs, a §6 iron was selected having a standard shaft length of 39". Approximately 5¼" was cut off the butt end of the shaft, and 9½" cut off the tip of the shaft, leaving approximately a shaft length of 23". In order to compensate for the weight loss of both ends of the shaft which were cut off, weights, such as 132 and 134, were added to the club end, the hosel, and to the handle in the same amounts as the tip and butt ends that were cut off, to compensate for the change in weight of the club. In a similar manner for driver 31, shaft 37 was reduced on either end, and weights, such as 133 and 135, were added to openings 33 at the club end and 35 at the handle end of the driver, to compensate for the reduction. It is also possible to merely increase the weight of the shaft and head proportionately to likewise balance the club. The clubs are shortened approximately equal to the height of the table above the floor level. The resulting clubs were found to have an excellent balance and simulate the swing of a standard golf club.

Figure 9:
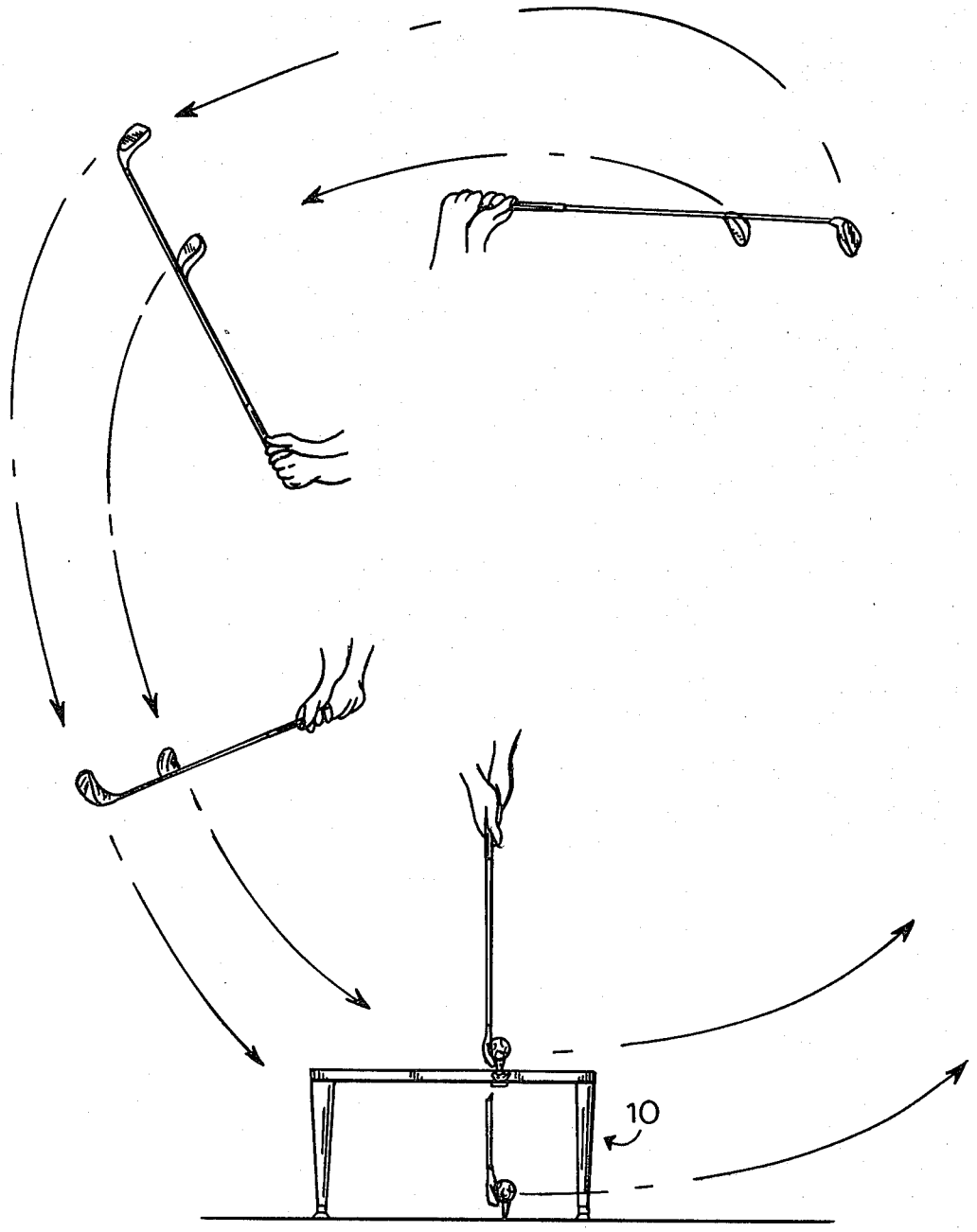
FIG. 9 is a front plan view illustrating the use of the golf practice table, in comparison with a standard golf club.
Figure 10:
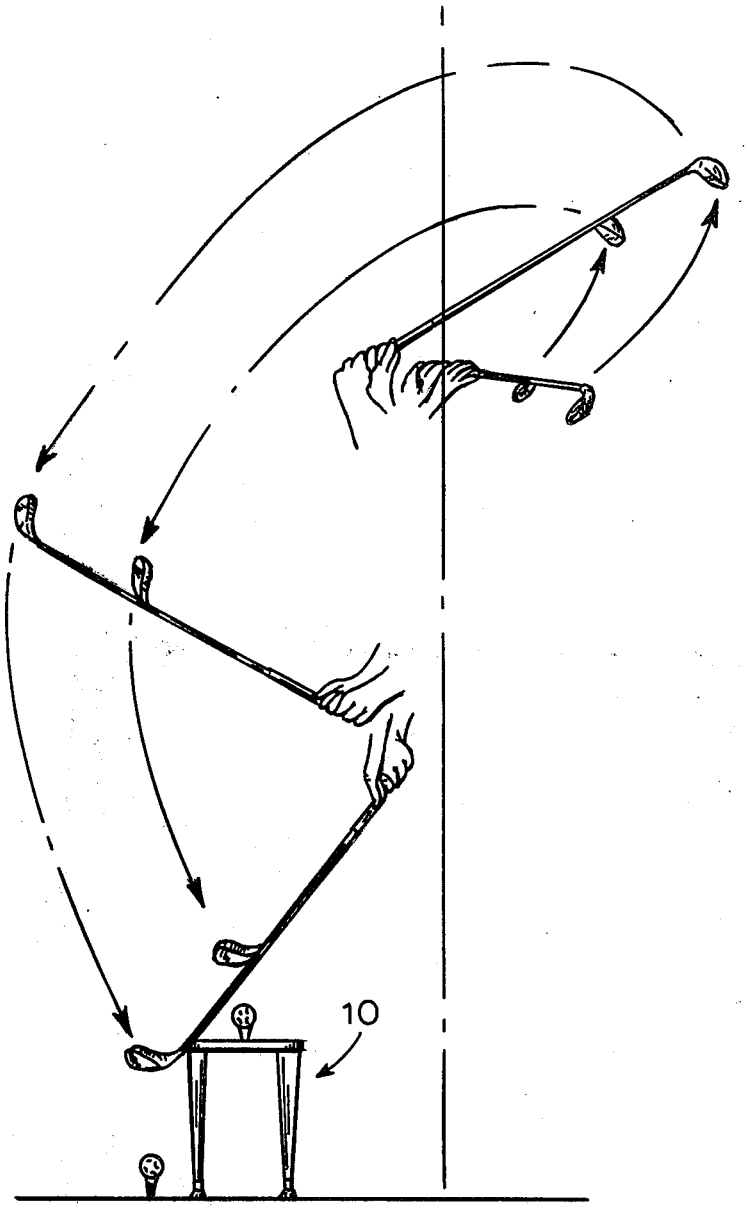
FIG. 10 is a side view, illustrating the use of the practice table and golf club, in comparison to a standard golf club, during a practice session.

As shown in detail in FIGS. 9 and 10, the swing of the shortened club using table 10 of the invention, can be accomplished within a approximate radius of 7′ in height from the floor on which table 10 sits, so that practice can be accomplished in a room having standard 7½ to 8′ ceilings. Likewise, referring to FIG. 10, the amount of distance needed for the side swing is considerably reduced because of the apparatus of this invention.

The present invention also improves one's skills in practice by helping line up the sight of the golf ball on tee 21, using the sighting hall 22 at the side of the platform. In actual use, either real golf balls can be driven into blankets or sheets suspended adjacent to the table, or plastic practice balls can be used. The table can be elevated to different heights so the player can practice short and long swings.

While only a few embodiments of the invention have been shown and described, it is obvious that many changes and modifications may be made thereunto, without departing from the spirit and scope of the invention.

What is claimed is:

1. A golf practice device for use over a floor area, comprising:

a golf platform having a plurality of legs of predetermined height for supporting said platform approximately 10 inches over the floor area, said platform including artificial grass disposed on the top surface thereof,;

means for individually lengthening and shortening each of said plurality of legs supporting said platform, so that the top surface thereof can be tilted to any desired orientation, and a shortened golf club reduced in size approximately equal to the predetermined height of said golf platform, said golf club having a length which permits a golf ball to be played indoors in a room having restricted ceiling height by a golfer, the shaft of said golf club including a weight at each end thereof to compensate for the weight loss resulting when the opposite ends were removed from a standard golf club shaft to produce the shaft of said shortened golf club, whereby when a golf ball is disposed on the top surface of said platform, a golf player can accomplish a full and balanced swing of the golf club indoors without obstruction.

2. The golf practice device as recited in claim 1, wherein said platform includes a golf tee.

3. The golf practice apparatus as recited in claim 1, wherein said platform additionally comprises a sighting ball mounted adjacent to the edge of said platform along a plane passing through said tee, and parallel to one edge of said platform.

4. The golf practice apparatus recited in claim 1, wherein said lengthening means comprises a threaded shaft disposed through the axis of each of said legs, for extending the length of each leg.

* * * * *